US007510053B2

(12) United States Patent
Wilkins

(10) Patent No.: US 7,510,053 B2
(45) Date of Patent: Mar. 31, 2009

(54) PLUG FOR MAIN OIL GALLERY

(75) Inventor: John A. Wilkins, Ypsilanti, MI (US)

(73) Assignee: SKF USA Inc., Elgin, IL (US)

( * ) Notice: Subject to any disclaimer, the term of this patent is extended or adjusted under 35 U.S.C. 154(b) by 406 days.

(21) Appl. No.: 10/897,865

(22) Filed: Jul. 23, 2004

(65) Prior Publication Data

US 2006/0054401 A1 Mar. 16, 2006

(51) Int. Cl.
*F16N 11/00* (2006.01)

(52) U.S. Cl. ..... 184/88.1; 215/335

(58) Field of Classification Search ..... 184/6.5–6.9, 184/88.1, 88.2, 92, 89, 94, 95; 123/196 R, 123/196 S, 198 DA, 198 D; 220/801, 803; 215/355; 138/90; 403/348, 349, 350, 351, 403/352, 353

See application file for complete search history.

(56) References Cited

U.S. PATENT DOCUMENTS 3,057,502 A * 10/1962 Wood ..... 215/355
3,467,395 A 9/1969 Kan
3,927,783 A * 12/1975 Bogert ..... 215/222
4,269,237 A * 5/1981 Berger ..... 141/346
4,736,865 A 4/1988 Rericha
4,822,061 A 4/1989 Kammeraad
4,867,043 A 9/1989 Antkowiak
4,993,994 A 2/1991 Ojima
5,071,020 A * 12/1991 Reutter ..... 220/203.06
5,680,954 A * 10/1997 Arnold et al. ..... 220/300
6,142,257 A 11/2000 Bruener et al.
6,289,865 B1 9/2001 Spix
6,877,529 B2 * 4/2005 Bernini ..... 138/89
2005/0279317 A1 * 12/2005 Leasure et al. ..... 123/195 R

* cited by examiner

*Primary Examiner*—Richard W L Ridley
*Assistant Examiner*—James Pilkington
(74) *Attorney, Agent, or Firm*—Vedder Price P.C.

(57) ABSTRACT

A plug assembly for the oil gallery of an internal combustion engine. The engine has a cylindrical passage leading from the interior to the exterior thereof. There is a circumferential groove in the passage. The plug includes a seal piece and an outer skirt portion subdivided into a piece having an outer end portion with a radial flange for snugly engaging said engine block, and an axially extending free end portion with a radially extending locking tab porting engaging the circumferential groove. The locking tab can move into and out of registration with the circumferential groove.

13 Claims, 5 Drawing Sheets

PLUG FOR MAIN OIL GALLERY

This invention relates generally to oil control in automotive and similar engines, and more particularly, to a specialized design of plug which will withstand the high pressures in the main oil gallery of such an internal combustion engine.

As is well known, the oil gallery communicates directly with the oil pump and serves as the main source of oil under pressure for lubricating various parts of the engine, including the main bearings, connecting rod bearings, camshaft bearings, etc. For casting reasons, there is an opening into the oil gallery from outside the engine block. Consequently, there must be a plug of some sort to seal this opening. Such a plug must be relatively permanent, be simple and easy to install and must withstand occasional pressures up to as much as 200 psi.

While oil pressure in an engine normally runs about 40 to 80 psi, for example, a much larger pressure surge may be seen in the oil when it is extremely cold, or when the other passages are temporarily blocked, or for some other reason. The oil pressure relief valve does not always function perfectly and, for this reason, and others, the pressure in the oil gallery may approach 200 psi.

Accordingly, it is necessary that the plug for the oil gallery be able to withstand this pressure. When it comes to various designs for this purpose, several designs have been used and/or proposed, but each of them includes a number of disadvantages. Since the desired plug for this purpose is to be used in an automobile, of which literally millions are produced each year, being reliable and capable of easy installation are paramount considerations. Economy is also extremely high on the list of desired features.

Prior attempts in this area have included a thread-in type plug for this part. However, the thread on the plug is usually one made by an automatic screw machine, and hence contains threads which must mate or register with cut threads in the engine block. Consequently, if the engine block is not tapped correctly, or if the threads are discontinuous, or if the threads are cut at an angle, or if there is some other problem, then the threaded plug will not meet the criteria for this application.

Moreover, with a threaded plug, there is always a chance of cross-threading in operation. Cross-threading though not considered likely, is nevertheless a factor to be considered, because these plugs are normally placed in the block by a robotic installer, which may conceivably have an alignment problem. This installation is done with a so-called Avdel plug, which is used in conjunction with an O-ring. The installation of the Avdel type plug and an O-ring also raises the problem of excessive cost. Accordingly, a threaded type plug is not the perfect solution to this type of problem.

Another type of solution which has been proposed for this problem includes merely press fitting a plug in the opening. However, such a press fit normally is not satisfactorily able to be placed in the block in such a way as to be certain to withstand the pressures involved.

Accordingly, it would be advantageous if it were possible to design a plug which could withstand the high pressures involved and which still could be manufactured at low cost.

There is also a need for a low cost plug which could be inserted with little or no labor and which would be a snap-in type installation, thereby insuring that the plug could be reliably installed to the proper depth, and which would not require rotational indexing.

Still further, there is a need for a plug of the type which could be inserted to the correct depth at all times, and which, as a safety factor, would include a flanged retainer such that the plug could not be inserted too far into the opening of the oil gallery.

Accordingly, it is an object of the invention to provide an improved plug for the engine oil gallery of the automotive or like engine.

Another object is to provide a composite plug which would include an elastomeric plug integrated with a steel reinforcing part, and which would be able to withstand the pressures excepted to be seen in the oil gallery.

A still further object is to provide a cup formed of steel or other metal, covered by an elastomeric member having sealing means such as ribs or the like on its exterior surface.

Another object of the invention is to provide a cup-like member which could be used in cooperation with a plastic snap-in fitting that would ensure a reliable installation.

A further object of this invention would be to provide a composite seal having a snap-in plastic component which includes a pair of snap-in flanges having portions adapted to be seated in a groove and which also would have skirt portions terminating in a radial flange to prevent excessive depth of installation, in other words, a plug which inherently has an axial installation gauge.

Another object is to provide an economical plug which would be made entirely of plastic and which could be secured using one or two O-rings in addition to the plastic component.

A still further object of the invention would be to provide a skirted plastic arrangement wherein the skirt would include both a radial flange for establishing the proper depth or "bottoming out" as well as a snap-in fitting for a radial groove into which a portion of the skirt would extend.

Another object of the invention would also be to provide a reliable plug at a low cost.

A still further object is to provide a low cost reliable plug which will withstand the necessary pressures in an oil gallery.

These and other objects of the present invention are achieved in practice by providing a plug having sealing means thereon and which includes, either separately or in a unitary piece, a skirt having both locking tabs, as well as a radial flange to insure proper installation in an engine block, the engine block having been prepared merely by cutting a radial grove therein.

These and other objects and advantages of the invention, and the manner of their attainment will become more clearly apparent when reference is made to the following description of the preferred embodiments of the invention set forth by way of example, and shown in the accompanying drawings, wherein like reference numbers indicate corresponding parts throughout.

DESCRIPTION OF THE PREFERRED EMBODIMENT OF THE INVENTION

While the invention may be practiced in various forms and the preferred embodiments are not to be intended as limiting, a description of such preferred embodiments will now be made.

Figure 1:
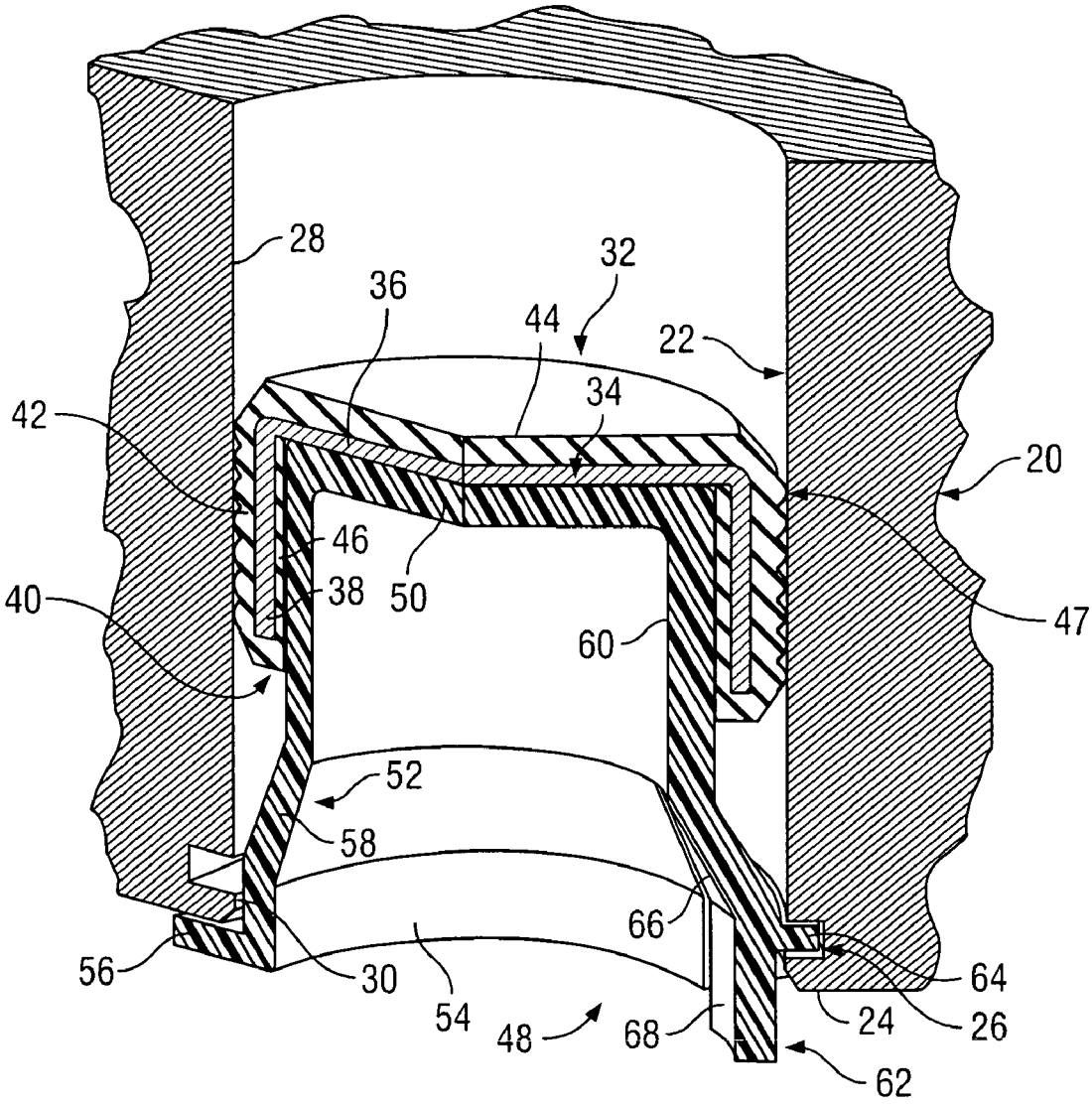
FIG. 1 is a perspective view of one embodiment of the invention, showing the inventive plug, the retainer and the groove for accommodating the snap-in flange as well as the radial flange on the bottom of the retainer.
Figure 2:
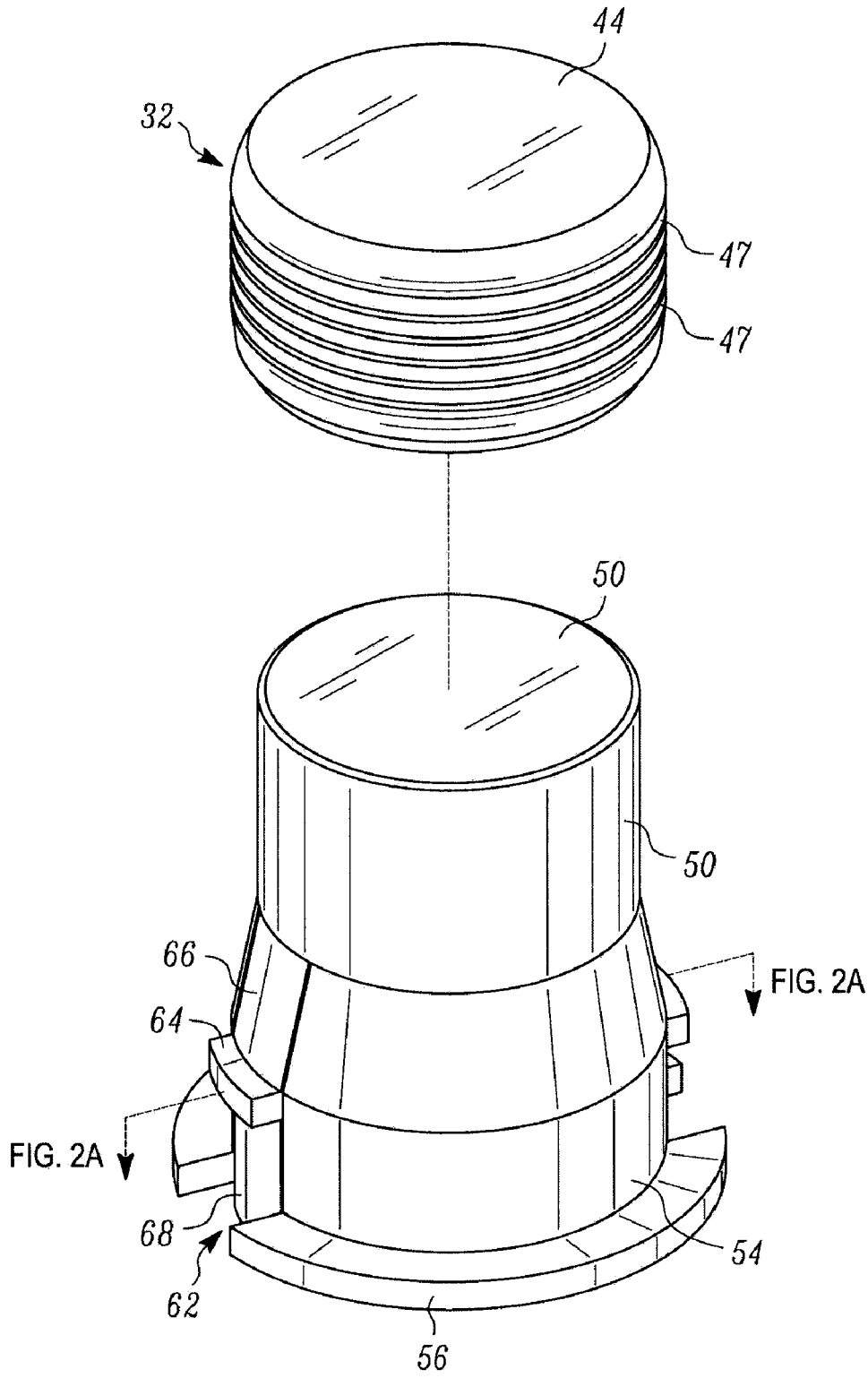
FIG. 2 is an exploded perspective view of the oil gallery seal of FIG. 1, showing the manner of inserting the retainer in the cup having seal means thereon.
Figure 2A:
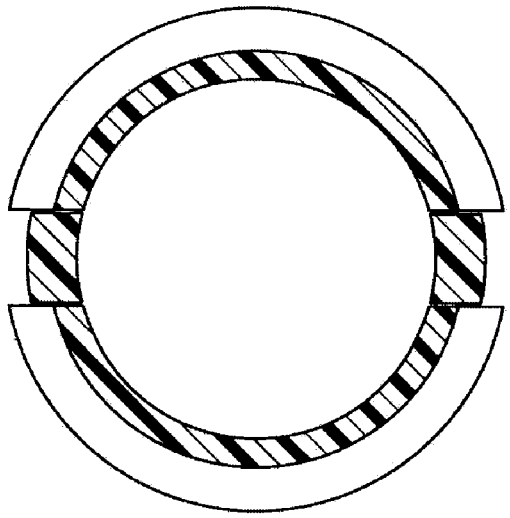
FIG. 2A of a horizontal sectional view of the plug of FIG.2, taken along lines 2A-2A of FIG. 2.
Figure 4A:
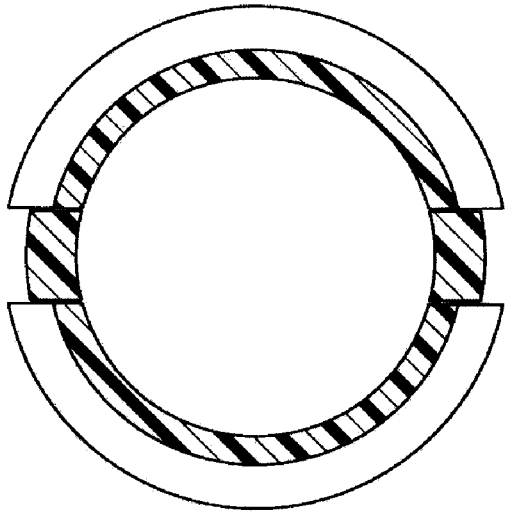
FIG. 4A is a horizontal sectional view of the plug of FIG. 4, taken along Lines 4A-4A of FIG. 4.

Referring now to drawings in greater detail. FIG. 1 shows a portion of an engine block generally designated 20 and shows a cylindrical bore therein generally designated 22, which forms a part of the main oil gallery of the engine. The engine block generally designated 20 includes the machined bore 22 and an outer end face portion 24.

On the inner surface of the bore 22, spaced just apart from the end face 24, is shallow, preferably rectangular groove generally designated 26. The groove 26 subdivides the gallery 22 into two sections, an axially inner section 28 and an axially outer section 30.

The engine block 20 and the main oil gallery 22 are somewhat schematically represented in this illustration. Located within in the gallery 22, which is cylindrical in form, is a composite plug generally designated 32. The plug 32 comprises two elements, one being a metal cup generally designated 34, having an end face section 36 and a continuous circular skirt portion 38. This cup 34 is overmolded with an elastomeric portion generally designated 40.

This overmolded component includes a radially outer, serrated or ribbed skirt portion 42, a flat crown portion 44 and a radially inner covering 46 for the skirt 38 portion. By "overmolded" is meant using the end face section 36 and the skirt portion 38 as part of the mold when forming the crown 44 and the serrated or ribbed skirt portion generally designated 42. The outer skirt portion may also include, in place of the ribs 42, a plurality of teeth or serrations 47, any of which are intended to make tight sealing contact with the bore 22.

Disposed inside this plug is a fairly tight fitting plastic support unit generally designated 48. The support unit 48 has a closed end face portion 50 as well as a skirt generally designated 52. The skirt 52 is subdivided into three main elements. The elements comprise a lower part 54 which is cylindrical in form and which has a terminal radial flange 56 designed to abut the end face 24 of the block 20 on its inner surface, a transition portion 58 and an upper portion 60 which fits tightly into the metal cup generally designated 34.

The transition portion 58 extends between the lower portion 54 and the upper portion 60 and is of an increasing diameter as it moves downward. The upper part 60 is of a constant diameter and meets and is joined to the uppermost or closed end portion 50 of the support unit 48. In this embodiment there are two separate spring-like elements, generally designated 62 (only one shown in FIG. 1), and each of which contains a radially outwardly extending locking tab 64, a movable or resiliently biased body portion 66 which meets and is joined to the upper portion 60, and a lower portion 68 which is also free from the flange 56 and is movable to place the locking tab into and out of the groove 26.

In use, the oil gallery passage 28 is normally bored to a given diameter and is a precisely formed opening. According to the invention, a groove 26 is cut in the lower end portion 30 of the oil gallery 22. No further preparation is required. When it comes time to insert the composite plug, it is done very simply and in a straightforward manner by first inserting the retainer carrying the metal cup with its ribbed rubber exterior into the opening 22 until the flange 56 bottoms out on the end face 24 on the engine block 20, and releasing the resiliently biased tabs 64, allowing them to engage the groove 26. Nothing else needs to be done to complete the installation.

Figure 3:
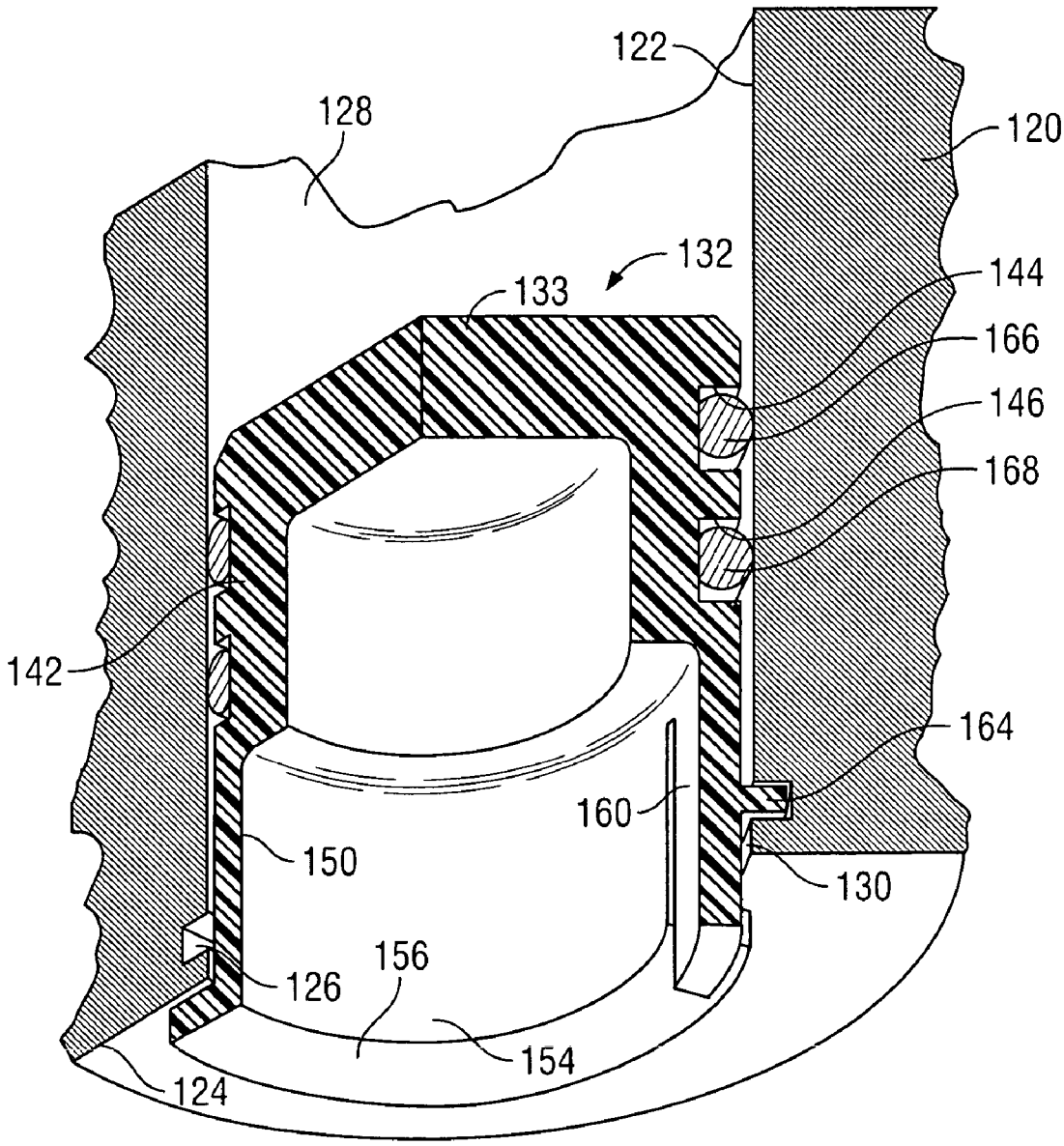
FIG. 3 is a perspective view of a somewhat different form of plug made from one piece, and also embodying the present invention.
Figure 4:
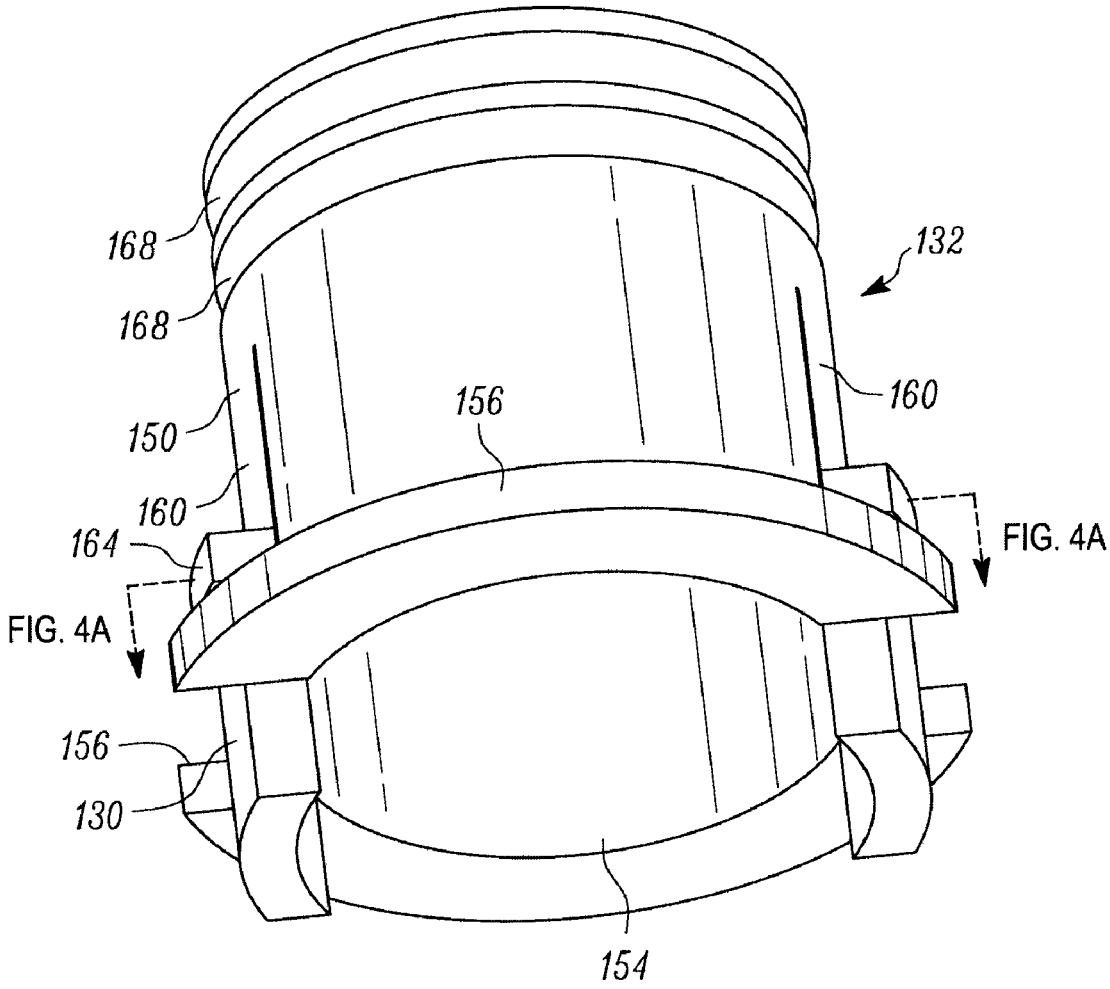
FIG. 4 is a perspective view of the plug showing the flexible walls and locking tabs of the present invention.

Referring now to another embodiment, a somewhat similar plug generally designated 132, but differing in several details, is shown in FIG. 3. Here, the engine block 120, the oil gallery 122, the lower end face portion 124 of the block, as well as the circumferential groove 126 subdividing the block into upper and lower portions 128 and 130, are all the same as they were in the earlier embodiments. Likewise, the flange 156 on the plug generally designated 132 is the same as in the earlier embodiment, except that, in this case, it extends from the bottom of a cylindrical skirt portion 150.

Referring now to the plug itself, this comprises an upper surface 133 or crown portion, and a downwardly extending body portion 142 having a plurality of grooves 144, 146 therein. A lower portion 154 of the body 142 contains a somewhat flexible, resiliently biased wall portion 160 having a resiliently biased locking tab 164 fitting into the groove 126.

In this embodiment, instead of the ribs 47 on the outside diameter of the plug 32, there are two O-rings 166, 168 disposed in the grooves 144, 146. These rings 166, 168 actually form the seal, with the plug 132 withstanding most of the force developed by the oil under pressure. With this arrangement of the flexible wall portion 160 and the locking tab 164 and the flange 156, the plug 132 is essentially immobile.

To install the plug, the same procedure as in the other embodiment is used. The plug 132 is simply inserted while the tabs 162 are withdrawn until the plug 132 bottoms out on the flange 156. Then the tabs are released from their withdrawn position and allowed to snap into the groove 126.

In a third embodiment (not shown), the plug of the invention could comprise only a single O-ring in a single groove. Likewise, the plug of the invention might have three or more O-rings.

Three embodiments have been shown. In addition, a number of variations are possible. The metal cup of the first embodiment could be made from a tough, hard plastic material. The form of the projections or serrations may be varied considerably. O-rings, one or more, are suggested, but another form of seal member could be substituted—square rings or the like could conceivably be used. A pair of continuous flanges have been suggested, but the flanges themselves could be made discontinuous. Other variations will occur to those skilled in the art.

It will thus be seen that the present invention provides an oil gallery plug having a number of advantages and characteristics, including those pointed out and others which are inherent in the invention. It is anticipated that one skilled in the art may make changes to the form of preferred embodiments shown herein without departing from the spirit of the invention, or the scope of the appended claims.

The invention claimed is:

1. In an internal combustion engine block having a continuous cylindrical oil passage between the interior and exterior of said engine block, said passage having a smooth interior wall terminating in an exterior end face, said passage having a right circular cylindrical groove being less than 30 millimeters from said exterior end face of said passage, a plug comprising three main portions including a first portion having a closed end face at one axial end of said plug, a second portion including a continuous circular cylindrical sidewall portion having sealing means thereon for engaging said smooth cylindrical passage in oil-tight relation, and a third portion including an axially remote skirt portion subdivided by four axial slits into a pair of portions each having a radial flange for engaging said exterior end face of said passage and a pair of portions each having a radially extending locking tab for engaging said circular cylindrical groove, whereby said third portion can be grasped and snapped into said cylindrical groove, said plug not requiring any rotary motion to be seated in said oil passage.

2. A plug assembly as defined in claim 1 wherein said sealing means comprises a cup overmolded with a plurality of projecting formations.

3. A plug assembly as defined in claim 2 wherein said cup is formed from a metal material.

4. A plug assembly as defined in claim 2 wherein said cup is formed from a rigid plastic material.

5. A plug assembly as defined in claim 2 wherein said radial projections are rounded so as to create a snug seal.

6. A plug assembly as defined in claim 2 wherein said cup includes an inner coating of an elastomeric material.

7. A plug assembly as defined in claim 1 wherein said sealing means comprises at least one O-ring, said O-ring being seated in an O-ring groove formed in said sidewall portion of said plug.

8. A plug assembly as defined in claim 1 wherein said sealing means comprises at least two O-rings, said O-rings being seated in grooves formed in said sidewall portion of said plug.

9. A plug assembly as defined in claim 1 wherein there are at least two radial flanges formed on said second skirt portion.

10. A plug assembly defined in claim 1 wherein there are four slits and two resiliently biased second portions of said skirt.

11. A sealing plug assembly for sealing an oil passage from the interior of an internal combustion engine block to the exterior of said block, said engine block having a smooth cylindrical sidewall defining said oil passage and terminating in a smooth exterior end face portion of said engine block, said passage having a circular cylindrical groove spaced between 2 mm and 30 mm from said exterior end face of said engine block, said plug assembly comprising in combination a one-piece snap-in fitting and oil seal unit, said snap-in fitting and oil seal unit including a plastic plug body and at least one elastomeric O-ring seal, said plastic plug body having a closed end face portion at one axial end of said plug, at least one intermediate sidewall portion having sealing means thereon and including at least one circumferential groove in said sidewall portion for accommodating said at least one O-ring seal, and an axially remote skirt portion subdivided by four axial slits into a pair of portions each having a radial flange for engaging said exterior end face of said passage, and a pair of portions each having a radially extending locking tab for engaging said circular cylindrical groove, said plug assembly not requiring any rotary motion to be seated securely in said oil passage.

12. A plug assembly as defined in claim 11 wherein said at least one O-ring comprises two O-rings.

13. A plug assembly as defined in claim 11 wherein said at least one O-ring comprises plural O-rings.

* * * * *